US009828788B2

(12) United States Patent
Zhou

(10) Patent No.: US 9,828,788 B2
(45) Date of Patent: Nov. 28, 2017

(54) CANOPY FRAMEWORK WITH LOCKING CAM LEVER

(71) Applicant: Hong Ting Zhou, Ningbo (CN)

(72) Inventor: Hong Ting Zhou, Ningbo (CN)

( * ) Notice: Subject to any disclaimer, the term of this patent is extended or adjusted under 35 U.S.C. 154(b) by 0 days.

(21) Appl. No.: 14/462,475

(22) Filed: Aug. 18, 2014

(65) Prior Publication Data

US 2015/0122301 A1 May 7, 2015

(30) Foreign Application Priority Data

Nov. 1, 2013 (CN) ..... 2013 2 0687177 U

(51) Int. Cl.
*E04H 15/50* (2006.01)
*E04H 15/48* (2006.01)
*E04H 15/46* (2006.01)

(52) U.S. Cl.
CPC ..... *E04H 15/50* (2013.01); *E04H 15/46* (2013.01); *E04H 15/48* (2013.01)

(58) Field of Classification Search
CPC ..... E04H 15/50; E04H 15/46; E04H 15/48
USPC ..... 135/120.2, 120.3, 140, 114; 403/109.2, 403/109.6
See application file for complete search history.

(56) References Cited

U.S. PATENT DOCUMENTS 3,606,372 A 9/1971 Browning
4,917,442 A 4/1990 Johnson
6,145,524 A 11/2000 Li et al.
6,152,157 A 11/2000 Jang
6,338,586 B1 1/2002 Kuo
6,575,656 B2 6/2003 Suh
7,097,380 B2 * 8/2006 Lee ..... F16B 7/105 15/80
7,293,934 B1 * 11/2007 Huang ..... 403/109.1
7,395,830 B2 * 7/2008 Seo ..... 135/140
7,422,026 B2 * 9/2008 Kim ..... 135/131
7,637,276 B2 12/2009 Mallookins et al.
7,980,519 B2 * 7/2011 Chen ..... 248/125.8
8,590,553 B2 * 11/2013 Lovley et al. ..... 135/120.2
8,893,737 B2 * 11/2014 Yang ..... 135/140
2006/0062632 A1 * 3/2006 Jang ..... 403/109.6
2014/0130837 A1 * 5/2014 Sy-Facunda ..... 135/120.3
2014/0174491 A1 * 6/2014 Yang ..... E04H 15/48 135/144

FOREIGN PATENT DOCUMENTS

CN 201320687177 11/2013
CN 201320722751 11/2013
WO WO 2007064112 A1 * 6/2007 ..... E04H 15/46

* cited by examiner

*Primary Examiner* — Noah Chandler Hawk
(74) *Attorney, Agent, or Firm* — Inskeep IP Group, Inc.

(57) ABSTRACT

A sliding connecting member for a shelter framework includes a sliding connecting member having a lever connected to a cam. When pulled or rotated, the lever pulls out a locking pin from an aperture in a leg member. In this respect, releasing the locking mechanism allows the sliding connecting member to slide along the leg member and the framework can be folded or unfolded.

19 Claims, 5 Drawing Sheets

CANOPY FRAMEWORK WITH LOCKING CAM LEVER

RELATED APPLICATIONS

This application claims priority to Chinese Utility Model Application No. 201320687177.4, filed Nov. 1, 2013, entitled Folding Canopy Framework, which is hereby incorporated herein by reference in its entirety.

BACKGROUND OF THE INVENTION

The evolution of light-weight, easily erected and economical portable shelters has led to the increasing commercial and private use of these structures. Portable shelters typically employ a cloth or plastic material attached to a light-weight, highly foldable skeleton or frame structure. The cloth provides a roof and/or walls for the shelter, and the frame structure provides support for the cloth, for example, the frame structure includes legs to elevate the roof and a system of trusses to support the roof and to generally stabilize the shelter. The frame structure often incorporates a compound, scissor-like, arrangement of a light-weight, tubular material such as aluminum. In order to maximize the usable area under a shelter, the frame structure is often designed so that the roof is supported solely by legs positioned near the perimeter of the roof. Stated alternatively, shelters do not typically employ an interior supporting post or leg such as a leg or post positioned in the center of shelter. U.S. Pat. No. 4,641,676 to Lynch, U.S. Pat. No. 7,367,348 to Tsai, and, and U.S. Pub. No. 20120048319 to Dotterweich, the contents of which are herein incorporated by reference, are examples of such portable shelters.

Some prior art frame structures used simple pins, such as push-pin or pull pin mechanisms to releasably support a frame structure in its expanded configuration. While these mechanisms typically provide adequate support, the relatively heavy weight of the upper portions of the framework can make them difficult to push or pull when trying to fold up the structure. Additionally, these pins are typically located in close proximity to sliding members and therefore, when pressed/pulled, can result in pinching or damage to a user's hand.

SUMMARY OF THE INVENTION

One embodiment of the present invention is directed to a sliding connecting member for a shelter framework. The sliding connecting member includes a lever connected to a cam that, when pulled, pulls out a locking pin from an aperture in a leg member. In this respect, releasing the locking mechanism allows the sliding connecting member to slide along the leg member.

BRIEF DESCRIPTION OF THE DRAWINGS

These and other aspects, features and advantages of which embodiments of the invention are capable of will be apparent and elucidated from the following description of embodiments of the present invention, reference being made to the accompanying drawings, in which.

DESCRIPTION OF EMBODIMENTS

Figure 1:
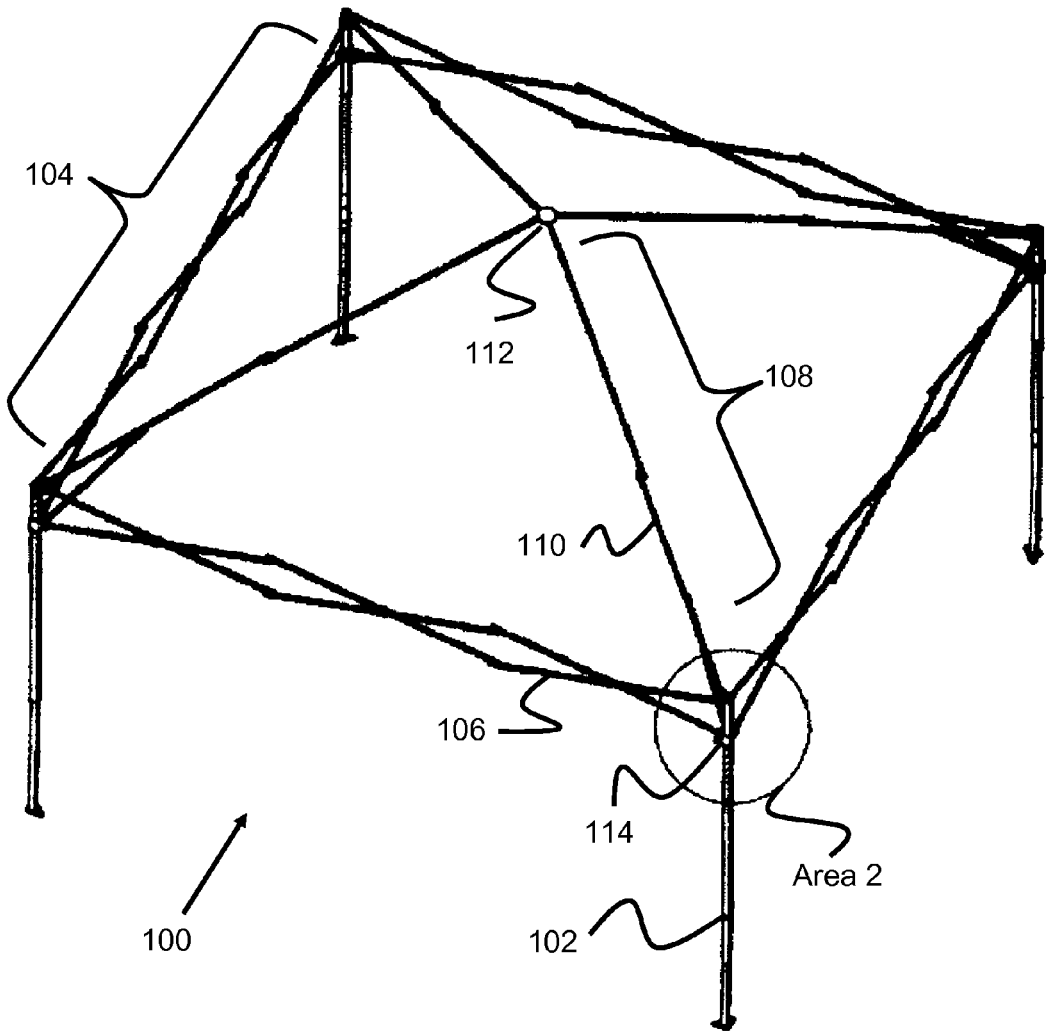
FIG. 1 is a perspective view of a framework according to the present invention.

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention. In the drawings, like numbers refer to like elements.

One embodiment of the present invention is directed to a framework for supporting a covering (e.g., cloth, fabric, plastic, etc.) on its top portion and having sliding connectors that can be selectively engaged via a lever member. These sliding connectors allow the framework to be more safely and easily engaged and disengaged to/from and expanded position.

FIG. 1 illustrates one example of a framework 100 according to the present invention, though almost any other shelter frameworks with a sliding connector can also be used in connection with the present invention. This example framework 100 includes four elongated leg members 102 that support the top of the framework 100 from the ground when expanded. Each leg member 102 is connected to two other legs via scissor linkages 104, which are each composed of a plurality of pivotally connected, elongated, frame members 106. Each of the leg members 102 are also connected to a center hub connector 112 via folding linkage 108, which is further composed of a plurality of elongated, pivotally connected frame members 110.

Figure 2:
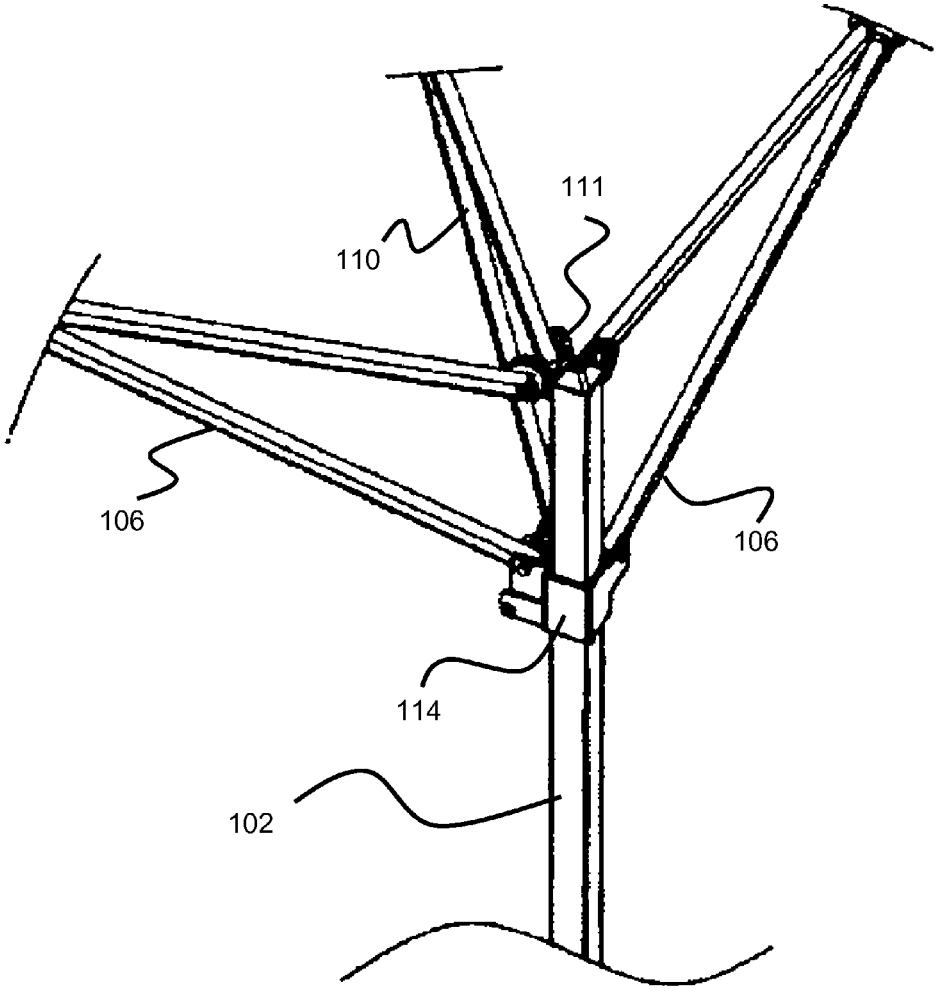
FIG. 2 is a magnified view of Area 2 in FIG. 1.

As best seen in FIG. 2, when the framework 100 is in a fully expanded position, a sliding connector 114 is locked at or near an upper end of the leg member 102. When the framework 100 is compressed or folded up, the sliding connector 114 is unlocked from the upper end of the leg member 102 and slid downwardly where it optionally may have a second locking location to help lock the framework 100 in its compress configuration. Since the sliding connector 114 connects to two members 106 and one member 110 (and fixed connector 111 also connects to two members 106 and one member 110), its movement along the leg member 102 either extends or retracts linkages 104, 108.

Figure 3:
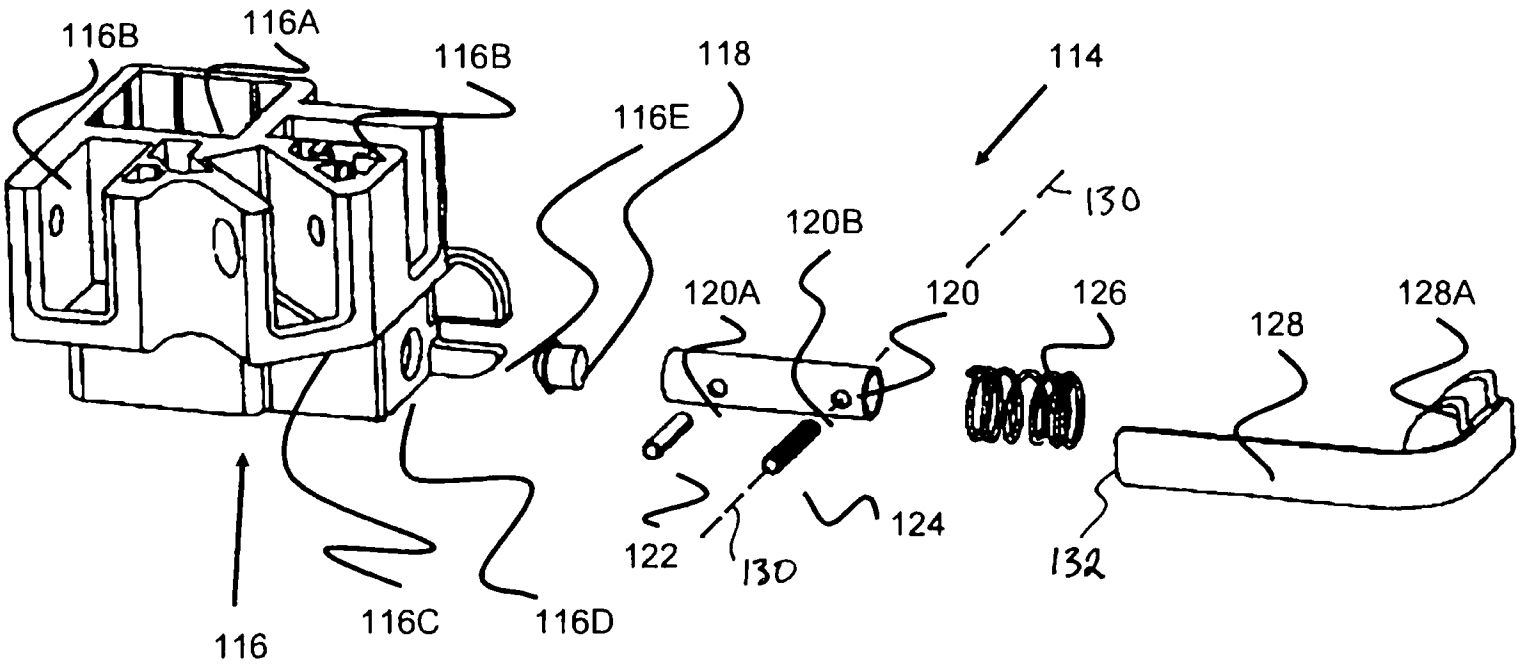
FIG. 3 is an exploded view of a sliding connecting member from the framework of FIG. 1.
Figure 4:
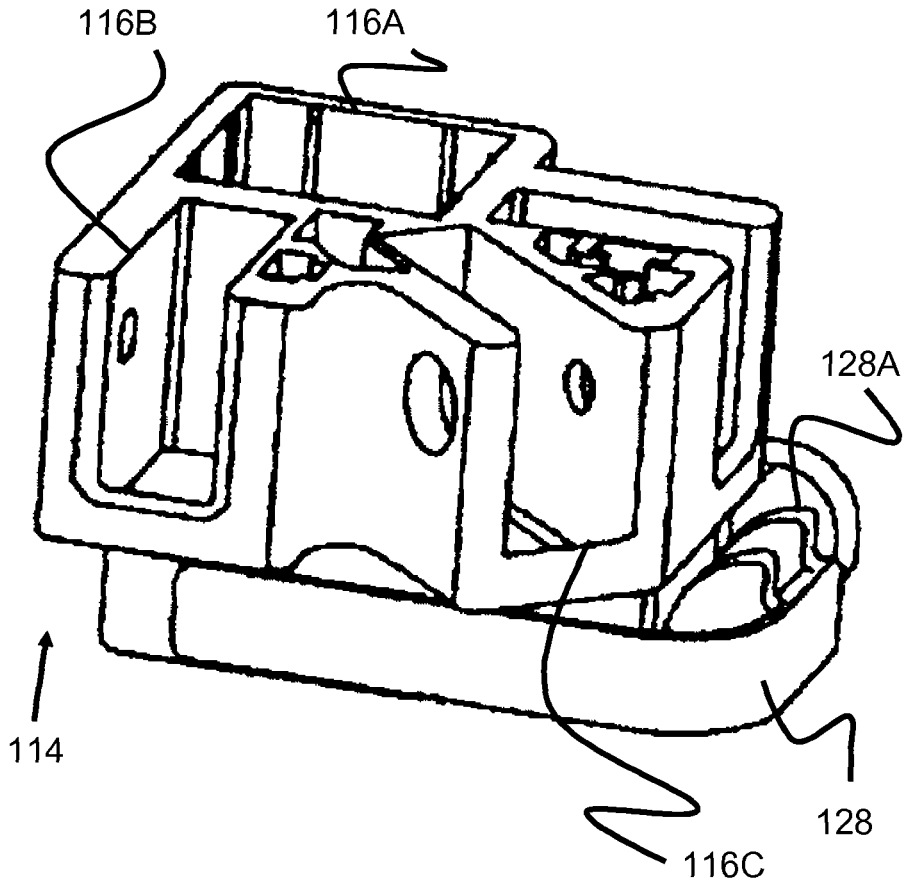
FIG. 4 is a perspective view of the sliding connecting member of FIG. 3; and, FIG. 5 is a cross sectional view of the sliding connecting member of FIG. 3.
Figure 5:
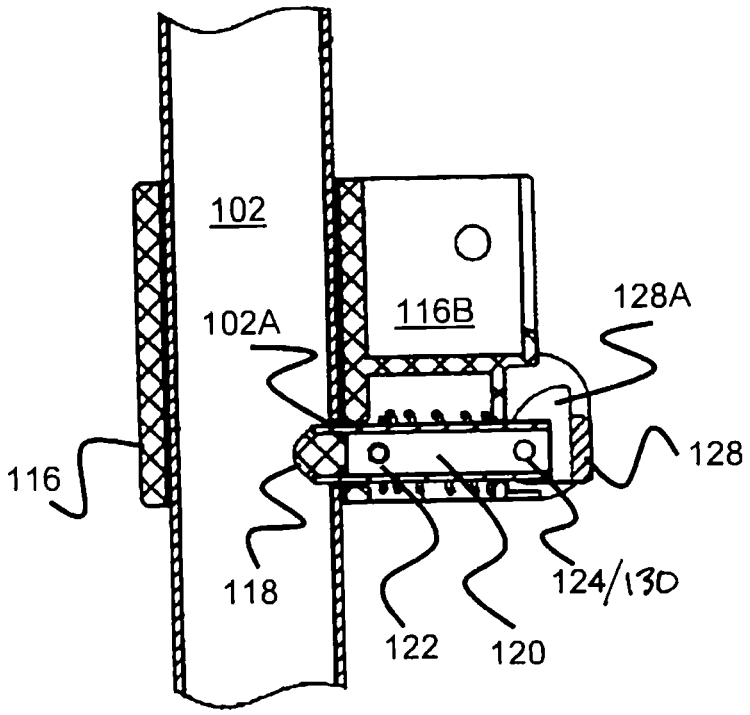

FIGS. 3-5 illustrates various views of the locking mechanism of sliding connector 114. The sliding connector 114 includes a main body member 116 having a sliding passage 116A that captures and slides over leg member 102, two pivoting areas 1168 that connect to members 106, and a pivoting area 116C that connects to member 110.

The locking mechanism includes a locking pin member 120 that slides into and out of an aperture 102A of the leg member 102, as best seen in FIG. 5. As best seen in the exploded view of FIG. 3, the pin includes a rounded tip portion 118 and two passage 120A and 120B that allow pin members 122 and 124, respectively, to pass through and extend out of the locking pin member 120. As seen in FIG. 5, the pin 122 acts as a stop, preventing the locking pin member 120 from passing too far into the aperture 102A, while also supporting the spring 126. The pin 124 pivotally connects the locking pin member 120 between two cam members 128A on the handle 128, allowing the handle 128 to pivot relative to the locking pin member 120. In other words, as shown in FIGS. 3 and 5, the pin 124 correlates with or otherwise represents an axis 130 about which the handle 128 pivots relative to the locking pin member 120.

FIGS. 4 and 5 illustrates the assembled sliding connecting member 114 with the handle member 128 in a horizontal position, such that the locking pin 120 is extended into the aperture 102A of the leg member 102. When the user wishes to unlock the position of the sliding connecting member 114, the handle member 128 is rotate downwards (e.g., towards or to a vertical position). As a distal end 132 of the handle member 128 moves down, the cam members 128A press against the side of the body member 116, against the bias of the spring 126, and urging the handle member 128 and locking pin member 120 outward/sideways in a direction opposite of the leg member 102. In this respect, the lever is preferably supported by horizontal groove 116E (e.g., by either the pin 124 or a similar feature on the cam member 128A) to provide vertical support while allowing horizontal movement. Hence, the lever handle member 128 acts as a lever, moving itself a distance away from the sliding connector 114.

The cam members 128A are preferably shaped such that they move the handle member 128 and locking pin 120 a sufficient distance so that the locking pin member 120 and tip 118 are completely withdrawn from the aperture 102A, thereby allowing the sliding connecting member 114 to slide along the leg member 102.

As previously discussed, the leg member 102 can have multiple apertures 102A. For example, one aperture 102A near the top of the leg member 102 to lock the framework 100 in an expanded position, and another aperture 102A near the bottom of the leg member 102 to lock the framework 100 in a compressed position. In another example, several apertures can be located near the top of the leg member 102 to lock the framework 100 at different heights.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A portable shelter framework comprising:

a plurality of elongated members connected to each other so as to form a folded and an unfolded portable shelter framework;

a sliding connector that is longitudinally transposable over an exterior of at least one of said plurality of elongated members; and a locking mechanism that selectively locks said sliding connector at a first position on said at least one of said plurality of elongated members; said locking mechanism comprising a locking pin and a lever arranged to move said locking pin between a locked and unlocked position, an axis about which the lever pivots positioned proximate an end of the locking pin that is opposite an end of the locking pin that engages said at least one of said plurality of elongated members;

a distal portion of the lever positioned in a generally horizontal orientation in said locked position and a downwardly-rotated, non-horizontal position in an unlocked position;

a distal end of the lever positioned proximate the end of the locking pin that engages said at least one of said plurality of elongated members when in the locked position.

2. The portable shelter framework of claim 1, wherein said lever further comprising a cam portion.

3. The portable shelter framework of claim 2, wherein said cam portion is configured to move said locking pin into and out of a first aperture of said at least one of said plurality of elongated members.

4. The portable shelter framework of claim 3, wherein said locking pin is biased to said locked position.

5. The portable shelter framework of claim 1, wherein, when in said locked position, said lever extends along a first vertical side of said sliding connector and along a second, adjacent vertical side of said sliding connector that is perpendicular to the first vertical side of said sliding connector.

6. A portable shelter framework comprising:

a plurality of elongated members connected to each other so as to form a folded and an unfolded portable shelter framework;

a sliding connector having a unitary body and a passageway through which at least one of said plurality of elongated members is inserted and longitudinally transposable;

a locking pin having a stop at least partially located within said sliding connector, the stop abutting the sliding connector and preventing the locking pin from passing into the passageway;

a spring positioned over the pin, a first end of the spring directly abutting the stop and a second end of the spring directly abutting the unitary body of the sliding connector; and a lever configured to move said locking pin into and out of an aperture of said at least one of said plurality of elongated members;

wherein said lever is positioned in a generally horizontal orientation when said locking pin is positioned into said aperture and wherein said lever is positioned in a downward, non-horizontal position when said locking pin is positioned outside of said aperture.

7. The portable shelter framework of claim 6, wherein said lever includes a cam surface.

8. The portable shelter framework of claim 7, wherein said lever is pivotally connected to said locking pin.

9. The portable shelter framework of claim 7, wherein said cam surface comprises two parallel-spaced cam members.

10. The portable shelter framework of claim 7, wherein said cam surface abuts an outer surface of said sliding connector.

11. The portable shelter framework of claim 10, wherein said lever has a first positioned in which said cam surface positions said lever at a first distance from said sliding connector and wherein said lever has a second position in which said cam surface positions said lever at a second distance from said sliding connector.

12. The portable shelter framework of claim 11, wherein a spring biases said lever to said first position.

13. The portable shelter framework of claim 12, wherein said first position of said lever positions said locking pin at least partially within one of said plurality of elongated members, and wherein said second position of said lever positions said locking pin completely outside of said one of said plurality of elongated members.

14. The portable shelter framework of claim 6, wherein the spring biases said locking pin into said aperture of said at least one of said plurality of elongated members.

15. The portable shelter framework of claim 6, wherein said locking pin further comprises an angled tip portion.

16. The portable shelter framework of claim 6, wherein, when said locking pin is positioned in said aperture, said lever extends along only a first vertical side and a second, adjacent vertical side of said sliding connector that is perpendicular to the first vertical side.

17. A method of unlocking a portable shelter framework, comprising:

pivoting a lever from a generally horizontal position downwards to a non-horizontal position so as to move a cam member to increase a distance between said sliding connector and said lever and to move a first end of a locking pin out of an aperture of one of a plurality of elongated leg members that form said portable shelter framework, an axis about which the lever pivots positioned proximate a second end of the locking pin that is opposite the first end of the locking pin;

sliding a sliding connector longitudinally along a portion of said one of said plurality of elongated leg members independent of said one of said plurality of elongated leg members; and collapsing said portable shelter framework.

18. The method of claim 17, wherein pivoting said lever comprises pivoting the lever from an initial position in which the lever extends along only a first vertical side and a second, adjacent vertical side of said sliding connector perpendicular to the first vertical side and a distal end of the lever is positioned proximate the first end of the locking pin.

19. The method of claim 17, wherein said sliding connector comprises a passage sized to allow movement of said locking pin.

* * * * *